US007212221B2

(12) United States Patent
Walsh et al.

(10) Patent No.: US 7,212,221 B2
(45) Date of Patent: May 1, 2007

(54) ROS SHUTTER SYSTEM

(75) Inventors: James D. Walsh, Rochester, NY (US); Douglas S. Smith, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 195 days.

(21) Appl. No.: 10/990,564

(22) Filed: Nov. 17, 2004

(65) Prior Publication Data

US 2006/0103717 A1 May 18, 2006

(51) Int. Cl.
*G03G 21/00* (2006.01)
*G03G 21/16* (2006.01)

(52) U.S. Cl. ..... 347/138; 347/245; 347/263

(58) Field of Classification Search ..... 347/263, 347/245, 138
See application file for complete search history.

(56) References Cited

U.S. PATENT DOCUMENTS 3,807,659 A 4/1974 Winfrey
4,657,372 A 4/1987 Ikeda et al.
4,875,063 A 10/1989 Idenawa et al.
4,943,815 A 7/1990 Aldrich et al.
5,105,299 A 4/1992 Anderson et al.
5,153,607 A 10/1992 Ichinokawa
5,157,416 A * 10/1992 Kinoshita et al. ..... 347/263
5,260,718 A 11/1993 Rommelmann et al.
5,311,349 A 5/1994 Anderson et al.
5,694,632 A 12/1997 Capper
6,038,417 A 3/2000 Nagamine et al.
6,072,572 A 6/2000 Hatfield et al.
6,188,661 B1 2/2001 Arai et al.
6,327,067 B2 12/2001 Koguchi
6,449,067 B2 9/2002 Shirakura et al.
6,673,061 B2 1/2004 Abe
7,002,615 B2 * 2/2006 Shim ..... 347/263
2002/0024585 A1 * 2/2002 Kim et al. ..... 347/228

* cited by examiner

*Primary Examiner*—Huan Tran
(74) *Attorney, Agent, or Firm*—Pillsbury Winthrop Shaw Pittman, LLP

(57) ABSTRACT

Raster Output Scanner (ROS) shutter system capable of blocking and unblocking harmful radiation selectably, semi-automatically or automatically. The system and uses thereof can be applied to various fields including scanners and printers.

15 Claims, 5 Drawing Sheets

ROS SHUTTER SYSTEM

BACKGROUND

Disclosed is a Raster Output Scanner (ROS) shutter system for protection against radiation generated in xerographic imaging equipment.

In image recording devices utilizing an electrostatographic system, a surface of a photoconductive drum or a photoreceptor is exposed to light (or some form of radiation) to form a latent image on the drum surface. Toner is then applied to the latent image to develop the image, and the developed image is transferred onto a recording sheet and is fixed by a fixing unit. Such an image recording device is employed in a copying machine as well as in a printer for printing output from a computer. It is well known in such machines that the user periodically will have to replace the cartridge containing the photoconductive drum and the toner after its useful life (in terms of the number of sheets) because the toner is used up and/or the photoconductor on the surface of the drum has worn thin or because a change in electrostatic characteristics results in defective charging or transfer as the photoconductive drum is repeatedly used. In some machines, a laser oscillator providing the required radiation may be accidentally actuated while replacing the cartridge, thereby directing a laser beam to the unprotected eyes of the operator, and possibly causing a serious problem.

Even though a switch may be provided to stop the operation of the oscillator in such situations, the suspension of the operation is not ensured if the switch is out of order. It is desirable, therefore, to provide an additional safety feature to assure that such a condition will not exist in such machines including the larger, more modern and more powerful printers such as the xerographic printing machines.

SUMMARY

Aspects disclosed herein include a system comprising a xerographic image receptor; an exposure device directing exposure radiation to the image receptor; an element that selectably blocks and unblocks an aperture of the exposure device; a lever connected to actuate the element; and a spring biased over the element. The element comprises a shutter blade, the exposure device is a Raster Output Scanner (ROS) and the exposure forms a laser beam.

a system further comprising a housing that supports the ROS; an extension to the lever; one end of a connector attached to the extension; the opposing end of the connector fixedly connected to the housing; and wherein the connector is capable of moving the extension of the lever semi-automatically to raise the element away from the view of the ROS.

a system further comprising a torsion spring biasing the shutter; an actuator arm opposing the torsion spring; a plunger configured to communicate with the actuator arm; wherein the plunger is further configured to communicate with the actuator arm such that when the system moves into a docking position, the actuator arm raises the shutter out of view of the ROS; and wherein when the system moves to undock, the actuator arm retreats and torsion spring automatically forces the shutter blade to a position to block the laser beam.

a method providing a system comprising at least one movable station having at least one Raster Output Scanner (ROS) operable with a laser beam, a service position, a xerographic shutter system, the shutter system having an actuator connected to a shutter blade; moving the station to the service position; rotating the actuator selectably in a first direction; performing work on the station; moving the actuator selectably in a second direction opposite the first direction; and moving the station away from the service position.

DETAILED DESCRIPTION

In embodiments there is illustrated:

a shutter system that can block the beam of an infra-red (IR) laser from exiting the xerographic cavity of a printer especially when the machine is undocked from an operational mode and is put into a diagnostic or service mode while the beam is still on. The shutter offers a final line of defense in the event that electrical interlocks are bypassed or have failed to block radiation from raster output scanners (ROS) employed in an electrophotographic printing machine such as the Xerox iGen3® shown in FIG. 1.

Figure 1:
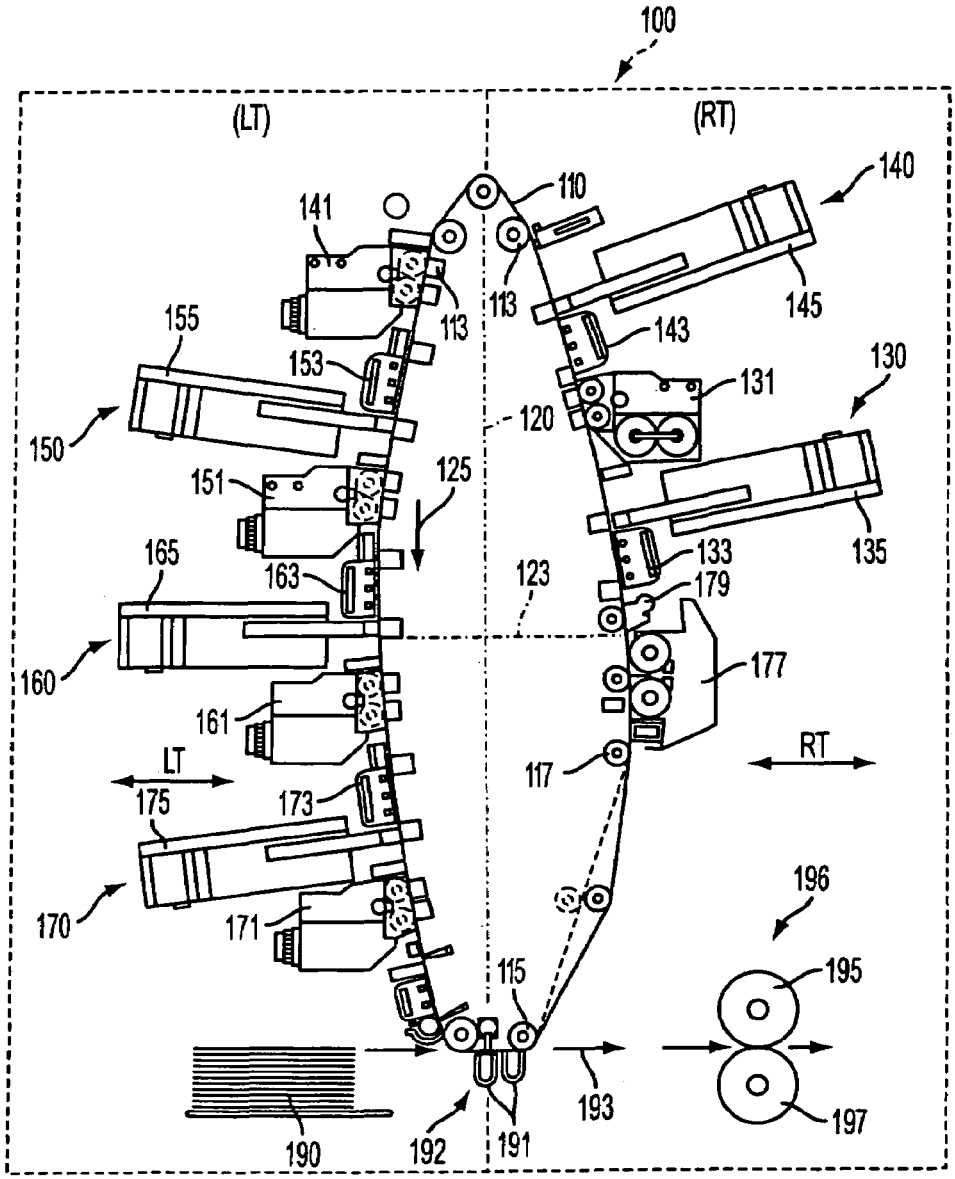
FIG. 1 is a schematic drawing showing the various components of an electrostatographic printing machine incorporating the present disclosure.

The printing machine 100 shown in FIG. 1 employs a photoconductive belt, sometimes referred to as photoreceptor belt 110 supported by a plurality of rollers or bars, 113. Photoconductive belt 110 is arranged in a vertical orientation. Photoconductive belt 110 advances in the direction of arrow 125 to move successive portions of the external surface of photoconductive belt 110 sequentially beneath the various processing stations disposed about the path of movement thereof. The photoconductive belt 110 (and its associated module 110' that holds the belt) has a major axis 120 and a minor axis 123. The major and minor axes 120, 123 are perpendicular to one another. Photoconductive belt 110 is elliptically shaped. The major axis 120 is substantially parallel to the gravitational vector and arranged in a substantially vertical orientation. The minor axis 123 is substantially perpendicular to the gravitational vector and arranged in a substantially horizontal direction. The printing machine architecture includes five image recording stations indicated generally by the reference numerals 130, 140, 150, 160, and 170, respectively. Initially, photoconductive belt 110 passes through image recording station 130. Image recording station 130 includes a charging device and an exposure device. The charging device includes a corona generator 133 that charges the exterior surface of photoconductive belt 110 to a relatively high, substantially uniform potential. After the exterior surface of photoconductive belt 110 is charged, the charged portion thereof advances to the exposure device. The exposure device includes a raster output scanner (ROS) 135, which illuminates the charged portion of the exterior surface of photoconductive belt 110 to record a first electrostatic latent image thereon. Alternatively, a light emitting diode (LED) may be used.

This first electrostatic latent image is developed by developer unit 131. Developer unit 131 deposits toner particles of a selected color on the first electrostatic latent image. After the highlight toner image has been developed on the exterior surface of photoconductive belt 110, photoconductive belt 110 continues to advance in the direction of arrow 125 to image recording station 140.

Image recording station 140 includes a recharging device and an exposure device. The charging device includes a corona generator 143 which recharges the exterior surface of photoconductive belt 110 to a relatively high, substantially uniform potential. The exposure device includes a ROS 145 which illuminates the charged portion of the exterior surface of photoconductive belt 110 selectively to record a second electrostatic latent image thereon. This second electrostatic latent image corresponds to the regions to be developed with magenta toner particles. This second electrostatic latent image is now advanced to the next successive developer unit 141.

Developer unit 141 deposits magenta toner particles on the electrostatic latent image. In this way, a magenta toner powder image is formed on the exterior surface of photoconductive belt 110. After the magenta toner powder image has been developed on the exterior surface of photoconductive belt 110, photoconductive belt 110 continues to advance in the direction of arrow 125 to image recording station 150.

Image recording station 150 includes a charging device and an exposure device. The charging device includes corona generator 153, which recharges the photoconductive surface to a relatively high, substantially uniform potential. The exposure device includes ROS 155 which illuminates the charged portion of the exterior surface of photoconductive belt 110 to selectively dissipate the charge thereon to record a third electrostatic latent image corresponding to the regions to be developed with yellow toner particles. This third electrostatic latent image is now advanced to the next successive developer unit 153.

Developer unit 153 deposits yellow toner particles on the exterior surface of photoconductive belt 110 to form a yellow toner powder image thereon. After the third electrostatic latent image has been developed with yellow toner, photoconductive belt 110 advances in the direction of arrow 125 to the next image recording station 160.

Image recording station 160 includes a charging device and an exposure device. The charging device includes a corona generator 163, which charges the exterior surface of photoconductive belt 110 to a relatively high, substantially uniform potential. The exposure device includes ROS 165, which illuminates the charged portion of the exterior surface of photoconductive belt 110 to selectively dissipate the charge on the exterior surface of photoconductive belt 110 to record a fourth electrostatic latent image for development with cyan toner particles. After the fourth electrostatic latent image is recorded on the exterior surface of photoconductive belt 110, photoconductive belt 110 advances this electrostatic latent image to the magenta developer unit 161.

Developer unit 161 deposits cyan toner particles on the fourth electrostatic latent image. These toner particles may be partially in superimposed registration with the previously formed yellow powder image. After the cyan toner powder image is formed on the exterior surface of photoconductive belt 110, photoconductive belt 110 advances to the next image recording station 170.

Image recording station 170 includes a charging device and an exposure device. The charging device includes corona generator 173 which charges the exterior surface of photoconductive belt 110 to a relatively high, substantially uniform potential. The exposure device includes ROS 175, which illuminates the charged portion of the exterior surface of photoconductive belt 110 to selectively discharge those portions of the charged exterior surface of photoconductive belt 110 which are to be developed with black toner particles. The fifth electrostatic latent image, to be developed with black toner particles, is advanced to black developer unit 171.

At black developer unit 171, black toner particles are deposited on the exterior surface of photoconductive belt 110. These black toner particles form a black toner powder image which may be partially or totally in superimposed registration with the previously formed yellow and magenta toner powder images. In this way, a multi-color toner powder image is formed on the exterior surface of photoconductive belt 110. Thereafter, photoconductive belt 110 advances the multi-color toner powder image to a transfer station, indicated generally by the reference numeral 192.

At transfer station 192, a receiving medium, i.e., paper, is advanced from stack 190 by sheet feeders and guided to transfer station 192. At transfer station 192, a corona generating device 191 sprays ions onto the backside of the paper. This attracts the developed multi-color toner image from the exterior surface of photoconductive belt 110 to the sheet of paper. Stripping assist roller 115 contacts the interior surface of photoconductive belt 110 and provides a sufficiently sharp bend thereat so that the beam strength of the advancing paper strips from photoconductive belt 110. A vacuum transport moves the sheet of paper in the direction of arrow 193 to fusing station 196.

Fusing station 196 includes a heated fuser roller 195 and a back-up roller 197. The back-up roller 197 is resiliently urged into engagement with the fuser roller 195 to form a nip through which the sheet of paper passes. In the fusing operation, the toner particles coalesce with one another and bond to the sheet in image configuration, forming a multi-color image thereon. After fusing, the finished-sheet is discharged to a finishing station where the sheets are compiled and formed into sets which may be bound to one another. These sets are then advanced to a catch tray for subsequent removal therefrom by the printing machine operator.

After the multi-color toner powder image has been transferred to the sheet of paper, residual toner particles usually remain adhering to the exterior surface of photoconductive belt 110. The photoconductive belt 110 moves over isolation roller 117 which isolates the cleaning operation at cleaning station 177. At cleaning station 177, the residual toner particles are removed from photoconductive belt 110. Photoconductive belt 110 then moves under spots blade 179 to also remove toner particles therefrom.

In an embodiment of the printing machine shown in FIG. 1, all the components associated with recording stations 130 and 140, including the cleaning station 177 and blades 179 to the right of the major axis 120 are housed in a unit hereafter called the right tower (RT), and the components associated with recording stations 150, 160 and 170, including developer unit 141 to the left of the major axis 120 are housed in a unit hereafter called the left tower (LT). The left tower is fixed and not movable. The right tower and the photoreceptor module are both movable such that they can be floatingly docked to the left tower. The towers are shown schematically in phantom outline in FIG. 1. It will be apparent to those skilled in the art that the undocking of the right tower and the photoreceptor module and belt 110 provides access to the various components of the system for service and diagnostic purposes. The system also has various electrical interlocks (not shown) to assure safety from laser beams discharging from the raster output scanners 135, 145, 155, 165 and 175 when in the undocked position. However, they are not described in detail here in order not to unnecessarily obscure the present disclosure. Mechanical shutter systems that provide additional safety are described in detail in the embodiments disclosed below.

Figure 2:
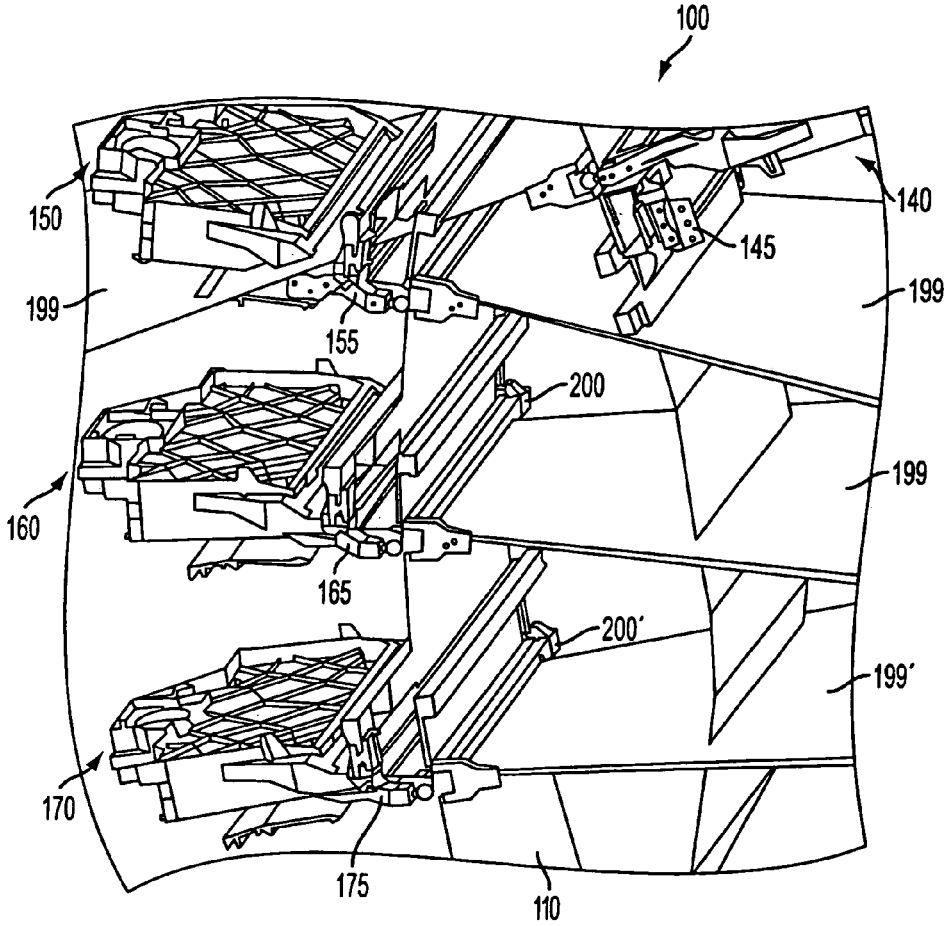
FIG. 2 is a perspective drawing of a section of the system of FIG. 1 showing the relationship between the recording or charging stations and the shutter system of the present disclosure.

Referring now to FIG. 2, a partial perspective view of the printing machine of FIG. 1 is shown with only a part of recording station 140 of the right tower (RT-not shown), and recording stations 150, 160 and 170 of the left tower (LT-not shown). FIG. 2 also shows laser beams 199 that are projecting from ROS 155, 165 and 175.

In an embodiment, laser beams 199 are blocked by mechanical shutters 200 shown in the perspective drawing of FIG. 2 when the right tower and the photoreceptor module and belt 110 are undocked. The operation of the mechanical shutter system 200 can be better seen in FIG. 3*a*.

Figure 3A:
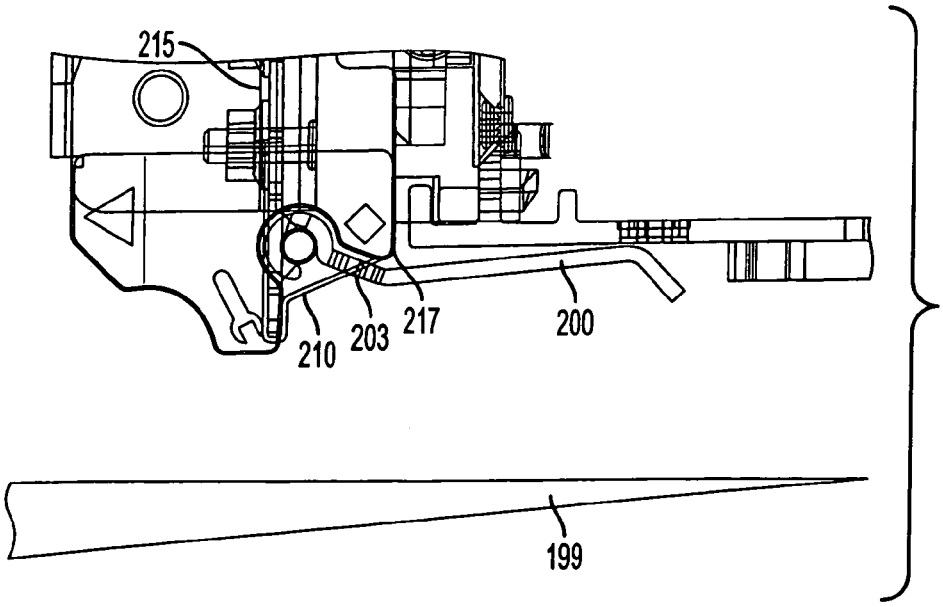
FIG. 3*a* is a cross-sectional drawing of a charging station of FIG. 2 showing the position of the shutter blade of the shutter system of the present disclosure not blocking a laser beam issued from a Raster Output Scanner (not shown).
Figure 3B:
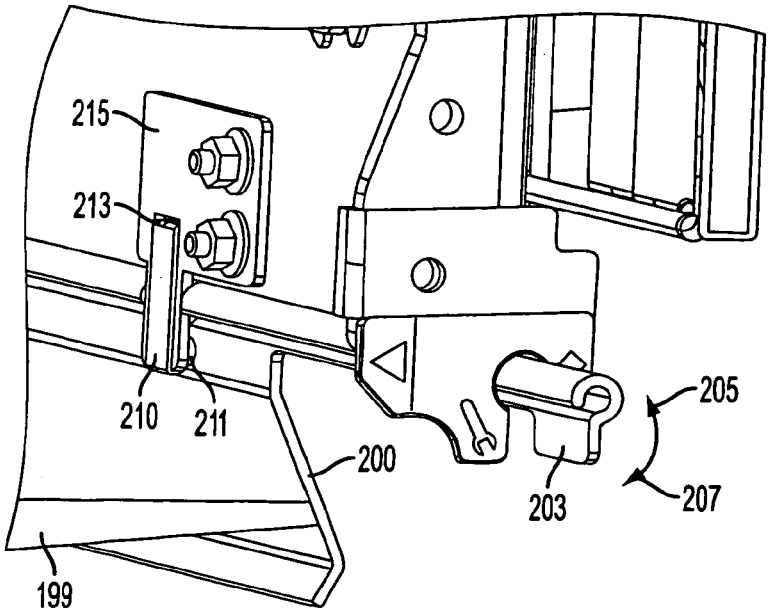
FIG. 3*b* is a perspective drawing of the shutter system of the present disclosure showing the position of a selectably operated handle when the shutter system is selectably moved to block the laser beam of FIG. 3*a*.

In FIG. 3*a*, laser beam 199 travels from a ROS (not shown) on the left to the right unimpeded, because mechanical shutter 200 is tucked upwards out of the way of the beam when the system is under operation. The up position is the normal position of shutter 200. In an aspect of an embodiment, the shutter is selectably actuated to lower it down when the machine is to be serviced or readied for diagnostic testing. This is accomplished by rotating lever 203 up 205 or down 207 positions as shown by the arrows in FIG. 3*b*. In the down 207 position, laser beam 199 is truncated by the blocking action of shutter 200. The shutter is urged upwards and held in the up position by a detent spring 210. The spring is a flat spring that operates as an over-the-center holding device. As the shutter is rotated between the service and the run position a portion of the shutter blade pushes over the center of the detent spring 210. The detent spring thus applies force to hold the shutter into either position once rotated past the center point. The center position is determined by a configuration having two pivot brackets that mount the shutter blade, one outboard and one inboard. The outboard position is located at outboard pivot mount 215 above the spring 210, while the inboard position is located at 217 not shown in FIGS. 3*a* and 3*b*.

It will be noted that while one end 213 of the detent spring 210 is fixed at the outboard pivot mount bracket 215, the other end 211 is free to float as it presses on the shutter blade so that it can accommodate slip and slide on the blade over a wide range of tolerances. Furthermore, because of the over-the-center cam design of the spring, lever 203 can be turned, but the shutter will only stop in the full down or full up position, and cannot be stopped positively at any angle. Manual rotation of the lever also provides a positive feedback to the operator as to whether the shutter is actually actuated or not. The shutter can be placed into service position at any time. The shutter can be used to block the ROS beam during trouble shooting without having to shut down the machine. Shutter 200 and rotating lever 203 may be machined from, but not limited to, extruded rigid PVC material. Pivot brackets 215 comprise, but not limited to, standard steel, and detent spring 210 comprises standard spring materials.

Figure 4A:
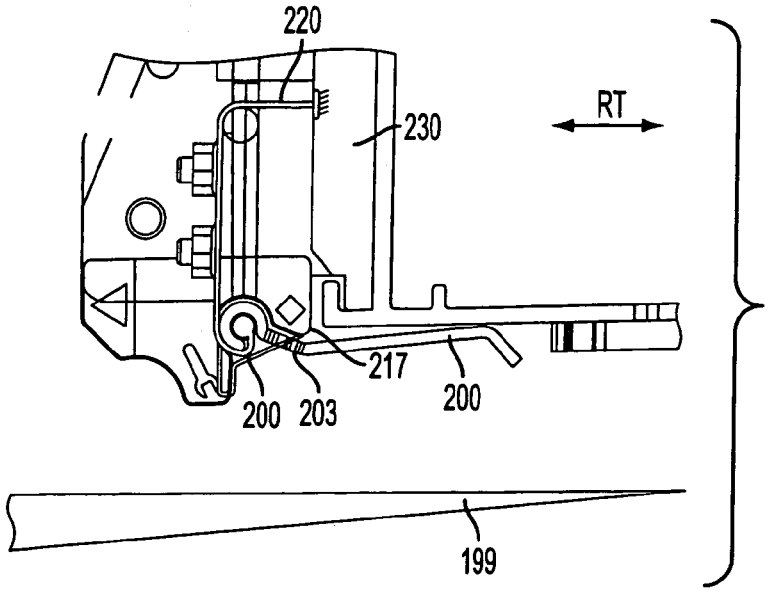
FIG. 4*a* is a cross-sectional drawing of a recording station of FIG. 3*a* showing an embodiment involving a semi-automatic shutter system utilizing an actuator or a handle to move the shutter blade of the present disclosure into a position where the shutter system does not block a laser beam issued from a Raster Output Scanner, ROS, (not shown).
Figure 4B:
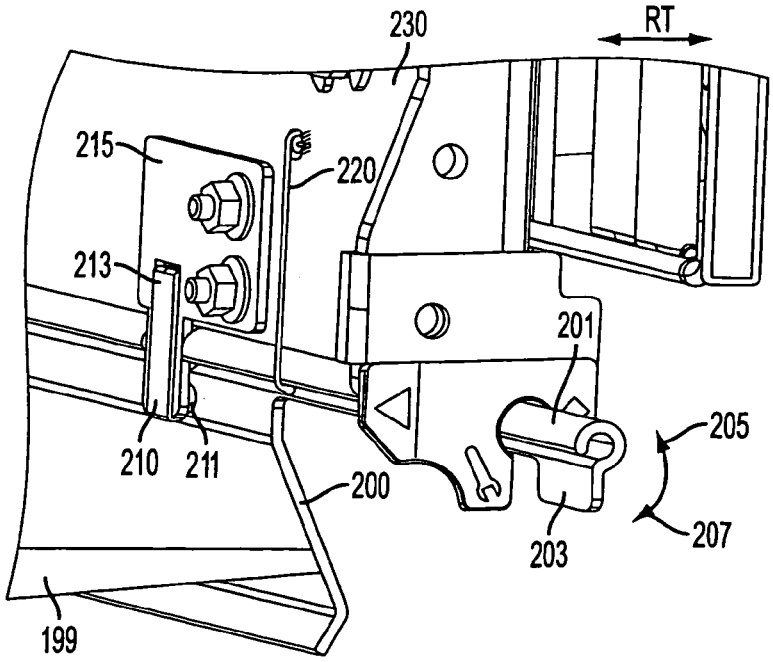
FIG. 4*b* is a perspective drawing of an embodiment of FIG. 4*a* showing the use of a cable for actuating the shutter blade to a position where it blocks radiation issuing from a ROS.

Another embodiment involves a semi-automatic mechanical ROS shutter system shown in FIGS. 4*a* and 4*b*, where similar numerals refer to similar parts. Shutter 200 is actuated by a cable assembly 220 to block the beam 199. In figure a, shutter 200 is in the up position, leaving the laser beam 199 unblocked and, therefore, in operational mode as was the case in FIG. 3*a*. In FIG. 4*a*, however, cable 220 is attached, for purposes of illustration here, to the corona generator or charge unit 173 of FIG. 1. Since the charge unit mount (represented by reference numeral 230 in FIGS. 4*a* and 4*b)* remains stationary during undocking, the charge unit will move to the right a short distance as the right tower and the photoreceptor are undocked. This movement pulls cable 220, which in turn rotates the shaft 201 of which lever 203 is a part, thereby causing shutter blade 200 to move clockwise downwardly to block the laser beam 199, as shown in FIG. 5*b*. This action puts the machine in service mode to service the machine in real time with no shut down without any concern for exposure to radiation from the laser. After service, the photoconductive belt 110 may be docked against the tower (shown in FIG. 1) while at the same time relieving the tension in cable 220. Since shaft 201 is no longer restrained by cable 220, the operator or a service technician can selectably rotate lever 203 to up 205 position to unblock beam 199 and proceed with the normal operation of the printing machine. In an aspect, it will be appreciated by those skilled in the art that the turn around time for service is substantially improved in comparison with current state of the art methods where the machine may be first shut down and then turned back on to avoid accidental exposure to harmful radiation.

Figure 5:
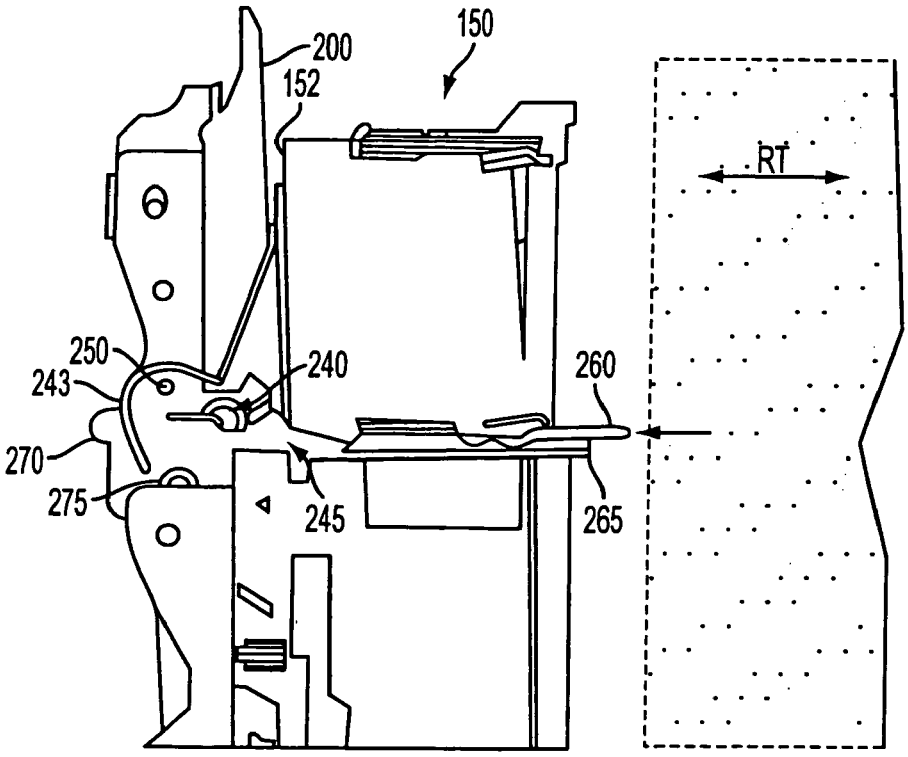
FIG. 5 is a side view drawing of an embodiment showing the use of a torsion spring and a plunger for automatic deployment and retrieval of the shutter system of the present disclosure to positively block and unblock a beam of radiation from a Radiation Emitting Device (RED).

In still another embodiment, a fully automatic mechanical ROS shutter system involves a preloaded torsion spring. FIG. 5 shows a portion (inverted for clarity) of the printing machine of FIGS. 1 and 2 in order to illustrate the parts of an automatic shutter system where ROS is not shown so as to not unnecessarily complicate the drawing. Recording station, say 150 in FIG. 1, is shown in an undocked state or service position in FIG. 5 where the laser beam (not shown) is blocked by shutter 200. The shutter is held in this "up" position (see FIGS. 3*b* and 4*b*) by means of a preloaded torsion spring 240 applying a counter clockwise rotational force to the shutter (blade) 200. The shutter is mounted between two pivot brackets providing pivot points 243 and 245. The shovel blade presses against a "thrust finger" 250 with a rotational force provided by torsion spring 240. The thrust finger is in its normal or home position as shown in FIG. 5. Actuation of the shutter begins as the right tower (RT) and the photoreceptor module move to their operational position. That is, for this illustration, the tower on the right and the photoreceptor module move from right to left. Actuation of the shutter starts as a portion of the photoreceptor module approaching from the right makes contact with a plunger 260. Plunger 260 is attached to a portion 265 of the charge unit 150, as shown in FIG. 5. A further movement of the tower causes the plunger 260 to contact an extension of actuator arm 270. As a result, the arm 270 begins to rotate about pivot point 250 causing the thrust finger 250 to rotate clockwise about pivot point 275. A clockwise motion by the thrust finger also imparts a clockwise rotation on the shutter 200. The force provided by the thrust finger overcomes the preloaded torsion spring and since the thrust finger is proximate to the shutter pivot point, only a relatively weak force is required to rotate the shutter blade clockwise to rest against the wall 152 of the charge unit 150. In one aspect, the shutter reaches the wall prior to the thrust finger reaches its final resting position. Consequently, the finger continues moving against a stationary shutter, hence stretching further and straightening out in a wiping motion over the surface of the shutter blade. Once the tower floatingly docks against the photoreceptor module, the shutter positively rests on the wall 152 of the recording station 150, thus unblocking the laser beam and setting the machine in operational or run mode. During undocking, the process is reversed, allowing the shutter to return to the service or diagnostic mode and block the laser beam from causing any unintended damage. It will be understood that a fully automatic shutter systems shortens machine downtime even further as no manual intervention is required in deploying the shutter either in docking or undocking operations.

It will be appreciated that variations of the above-disclosed embodiments and other features and functions, or alternatives thereof, may be desirably combined into many other different devices or applications. For example, the shutter systems disclosed above may be used for blocking radiation from a radiation emitting device (RED) in general with or without practicing all the details disclosed herein. Also that various presently unforeseen or unanticipated alternatives, modifications, variations or improvements therein may be subsequently made by those skilled in the art which are also intended to be encompassed by the following claims.

What is claimed is:

1. A system comprising:

an image photoreceptor;

an exposure device configured to direct exposure radiation to the image photoreceptor;

a blade-shaped shutter element that selectably blocks and unblocks the exposure radiation directed by the exposure device;

a rotating lever, coupled to the shutter element, and configured to:

(a) actuate the shutter element to a blocked position that obstructs the exposure radiation when the lever is rotated in one direction, and (b) actuate the shutter element to an unblocked position that permits the directed exposure radiation when the lever is rotated in an opposite direction; and a spring configured to bias the shutter element in order to maintain the blocked and unblocked positions.

2. The device in accordance with claim 1, wherein said exposure device is a Raster Output Scanner (ROS).

3. A system in accordance with claim 2, further comprising:

a housing that supports said ROS;

an extension to said rotating lever;

one end of a connector attached to said extension; and an opposing end of said connector fixedly connected to said housing;

wherein said connector is capable of moving configured to move said extension of said lever semi-automatically to raise said shutter element to the unblocked position.

4. The system in accordance with claim 3, wherein said extension to said lever is a shaft.

5. The system in accordance with claim 4, wherein said connector is a cable capable of wrapping around said shaft.

6. The system in accordance with claim 3, wherein said housing comprises a first and a second tower of a printing machine in which one or more of said ROS can be mounted in either the first or the second or both towers.

7. The system in accordance with claim 1, wherein said radiation exposure comprises a laser beam.

8. The system in accordance with claim 1, wherein said shutter element is in the blocked position when lowered to the front of said exposure device.

9. The system in accordance with claim 1, wherein said shutter element is in the blocked position when raised.

10. The system in accordance with claim 1, wherein said spring has a fixed end and a free end.

11. The system in accordance with claim 1, wherein said shutter element is opaque to the exposure radiation.

12. A system in accordance with claim 1, further comprising:

a torsion spring biasing said shutter element;

an actuator arm opposing said torsion spring;

a plunger configured to communicate with said actuator arm;

wherein said plunger is further configured to communicate with said actuator arm so that when said system moves into a docking position, said actuator arm raises said shutter element into the unblocked position; and wherein when said system moves to undock, said actuator arm retreats and torsion spring automatically forces said shutter element to the blocked position.

13. The system in accordance with claim 12, wherein said torsion spring is fixed at one pivot point for said actuator arm and said shutter element.

14. The system in accordance with claim 12, wherein said actuator arm actuates said shutter element against said torsion spring.

15. The system in accordance with claim 12, wherein said plunger contacts said actuator arm to actuate said shutter element automatically into the blocked and unblocked position.

* * * * *